US009051631B2

(12) United States Patent
Wu et al.

(10) Patent No.: US 9,051,631 B2
(45) Date of Patent: Jun. 9, 2015

(54) WELDABLE, CRACK-RESISTANT CO-BASED ALLOY, OVERLAY METHOD, AND COMPONENTS

(75) Inventors: James B. C. Wu, St. Louis, MO (US); Matthew X. Yao, Belleville (CA)

(73) Assignee: Kennametal Inc., Latrobe, PA (US)

( * ) Notice: Subject to any disclaimer, the term of this patent is extended or adjusted under 35 U.S.C. 154(b) by 976 days.

(21) Appl. No.: 12/669,429

(22) PCT Filed: Jul. 11, 2008

(86) PCT No.: PCT/US2008/069778

§ 371 (c)(1), (2), (4) Date: Apr. 15, 2010

(87) PCT Pub. No.: WO2009/012144

PCT Pub. Date: Jan. 22, 2009

(65) Prior Publication Data

US 2010/0209286 A1 Aug. 19, 2010

Related U.S. Application Data

(60) Provisional application No. 60/950,072, filed on Jul. 16, 2007.

(51) Int. Cl.
*C22C 19/07* (2006.01)

(52) U.S. Cl.
CPC ..... *C22C 19/07* (2013.01)

(58) Field of Classification Search
USPC ..... 420/436, 440
See application file for complete search history.

(56) References Cited

U.S. PATENT DOCUMENTS

| | | | |
|---|---|---|---|
| 2,538,882 | A | 1/1951 | Schonberg |
| 4,353,742 | A | 10/1982 | Crook |
| 4,465,515 | A | 8/1984 | Mundorff |
| 4,556,607 | A | 12/1985 | Sastri |
| 4,618,474 | A | 10/1986 | Ohe et al. |
| 4,650,725 | A | 3/1987 | Bose et al. |
| 4,689,463 | A | 8/1987 | Shubert |
| 4,692,305 | A | 9/1987 | Rangaswamy et al. |
| 5,002,731 | A | 3/1991 | Crook et al. |
| 5,360,961 | A | 11/1994 | Ingall et al. |
| 6,124,564 | A | 9/2000 | Sue et al. |
| 6,479,014 | B1 | 11/2002 | Wu et al. |

(Continued)

FOREIGN PATENT DOCUMENTS

| | | |
|---|---|---|
| FR | 1322149 | 3/1963 |
| JP | 4202732 | 7/1992 |
| WO | 2006/060434 | 6/2006 |

OTHER PUBLICATIONS

International Search Report, PCT/US08/69778, dated Jan. 28, 2010, 7 pages.

(Continued)

*Primary Examiner* — Kaj K Olsen
*Assistant Examiner* — Alexander Polyansky
(74) *Attorney, Agent, or Firm* — Larry R. Meenan

(57) ABSTRACT

A wear- and corrosion-resistant alloy, and related application method, where the alloy has by approximate weight %, C 0.12-0.7, Cr 20-30, Mo 7-15, Ni 1-4, and Co balance, wherein the alloy further contains one or more carbide-former elements from the group consisting of Ti, Zr, Hf, V, Nb, and Ta in a cumulative concentration to stoichiometrically offset between about 30% and about 90% of the C in the alloy.

6 Claims, 2 Drawing Sheets

(56) References Cited

U.S. PATENT DOCUMENTS

| | | | |
|---|---|---|---|
| 6,733,603 | B1 | 5/2004 | Wu et al. |
| 6,852,176 | B2 | 2/2005 | Wu et al. |
| 2005/0142026 | A1 | 6/2005 | Wu et al. |
| 2006/0210826 | A1 | 9/2006 | Wu et al. |

OTHER PUBLICATIONS

Abstract of JP4202732; Jul. 23, 1992.

International Search Report, PCT/US08/69778, dated Oct. 3, 2008, 3 pages.

Written Opinion, PCT/US08/69778, dated Oct. 3, 2008, 7 pages.

ASM International, Materials Park, Ohio, Welding, Brazing, and Soldering: Hardfacing, Weld Cladding, and Dissimilar Metal Joining, vol. 6, pp. 789-829, Dec. 1993.

WELDABLE, CRACK-RESISTANT CO-BASED ALLOY, OVERLAY METHOD, AND COMPONENTS

REFERENCE TO RELATED APPLICATION

This application claims priority from provisional U.S. application 60/950,072, filed 16 Jul. 2007, the entire disclosure of which is incorporated by reference.

FIELD OF THE INVENTION

The present invention relates generally to a Co-based alloy. More particularly, the invention relates to a ductile Co-based alloy that provides wear and corrosion resistance in the form of a cast component, powder metallurgy component, or component with the alloy as an overlay surface treatment on substrates. The invention is especially applicable to application by weld build up on large surfaces where cracking is a risk due to thermal phenomena during cooling.

BACKGROUND OF THE INVENTION

Cobalt-based alloys are used in many wear or abrasion-intensive applications because of their excellent wear resistance and ability to alloy well with many desirable alloying elements. One potential problem with Co-based alloys is their corrosion resistance when exposed to a corrosive medium, such as seawater, brackish water, mineral oil-based hydraulic fluids, acids, and caustics. One way that Co-based alloys have been designed to display improved corrosion resistance is by including Mo and Cr. But the simultaneous presence of C in many Co-based alloys can reduce the efficacy of these alloying elements by forming carbides. Therefore, the C concentration in Co-based alloys traditionally has been decreased to allow the Mo and Cr additions to impart improved corrosion resistance to the alloy. The lowered C concentration, however, has the undesirable effect of lowering the alloy's overall hardness, thereby reducing the alloy's wear resistance. So Co-based alloys for use in wear environments usually have a C content over 0.1%.

Further, Co-based alloys are particularly useful in high temperature applications because of Co's high melting point. But forming entire components using Co-based alloys is cost prohibitive. For example, it is cost prohibitive to form a 500 lb. component from a Co-based alloy, whereas forming a Co-based overlay on a Fe-based substrate is much cheaper. Therefore, to still take advantage of Co-based alloys' desirable properties, one common use of Co-based alloys is as a surface treatment, e.g., a coating or overlay, on substrates. Because of the high heat involved in applying Co-based alloys as a surface treatment, preheating the substrate is often required to avoid cracking of the overlay as it cools. Preheating is difficult or commercially impractical when the Co-based alloy is being applied to large substrates. Furthermore, substrates made of heat treated metals may not be heat-treatable at all because such a procedure would cause distortion or degradation of intended substrate properties. Therefore, to successfully treat a substrate surface with a Co-based alloy without preheating, the alloy must have sufficient flow characteristics in molten form and ductility during and after solidification. It must also have thermal characteristics compatible with deposition onto a relatively cooler substrate without preheating.

U.S. Pat. No. 5,002,731 discloses Co—Cr—Mo—W alloys with C and N for improved corrosion and wear resistance. These alloys have a low C content, so they lack resistance to abrasive wear due to insufficient precipitated carbide particles.

U.S. Pat. No. 6,479,014 discloses higher C alloys of Co—Cr—Mo and Co—Cr—Mo—W for saw teeth. These are designed for both wear and corrosion resistance, but they can be brittle from excessive precipitated carbides, and significantly, from the formation of intermetallic phases.

DETAILED DESCRIPTION OF THE PREFERRED EMBODIMENTS

Figure 1:
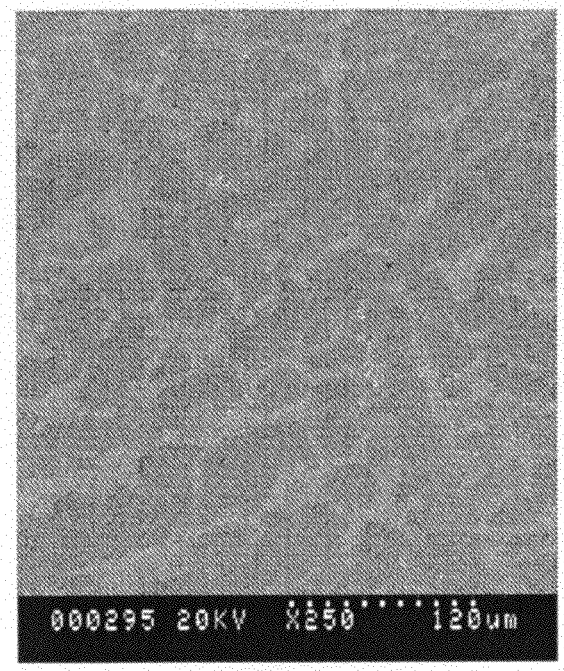
FIG. 1 is a photomicrograph of the microstructure of an alloy of the invention.

In accordance with this invention, a Co-based alloy is provided that has improved corrosion and wear resistance. It is in the form of a casting, or a powder metallurgy component, or can be applied via a surface treatment operation without requiring preheating the substrate. In the instance of surface treatment, despite the absence of preheating, the alloy does not fracture, nor do the properties otherwise degrade, during solidification. The Co-based alloy is suitable for weld overlay applications on large scale substrates. In one aspect, therefore, the invention is a Co—Cr—Mo wear- and corrosion-resistant overlay on a metallic component such as a hydraulic cylinder or other large-surface industrial component. The overlay surface area is typically greater than about 1 $m^2$, such as between about 1 $m^2$ and about 10 $m^2$. The thickness of the overlay is at least about 50 microns, such as between about 50 microns and about 10 mm.

In another aspect, the invention is an alloy in the form of a rod, consumable electrode, or wire used to form the overlay of the invention. This alloy could also be in the form of a cast or a powder metallurgy component.

The invention involves build-up with Co-based alloys because Co-based alloys display resistance to heat, abrasion, corrosion, galling, oxidation, thermal shock, and wear, which are desirable properties for many applications. Further, Co alloys well with several desirable alloying elements and tends to form a tough matrix.

The invention is, therefore, in one aspect a Co-based alloy for a weld overlay process.

According to this invention, C is employed in the alloy to improve the final alloy's wear resistance. This is accomplished by reacting with other alloying elements to form hard carbides, such as Cr or Mo carbides. Most wear-resistant cobalt alloys contain carbon over 0.1% by weight because it is necessary to form carbides for the desirable wear properties. However, the formation of carbides is at the expense of tying up the alloying elements, such as, Cr and Mo, which are keys to corrosion resistance. As a result, the corrosion resistance is reduced. In this invention, therefore, the concentration of C is closely controlled because excessive amounts can cause brittleness and diminish the efficacy of Cr or Mo. In one embodiment, the concentration of C in the alloy is between about 0.12 wt % and about 0.7 wt %. For example, one embodiment has a C concentration between about 0.2 wt % and about 0.4 wt %. In one preferred embodiment, the C concentration is about 0.36 wt %.

A foundation of this invention is to employ Mo and Cr for corrosion resistance, and to form carbides without consuming Mo and Cr. This way Mo and Cr remain in solid solution in the matrix, and are therefore available to form passivating films on the alloy surface in corrosive environments.

Although Mo is very effective in resisting corrosion, it readily forms intermetallic compounds in addition to carbides, e.g., Laves phase, mu phase, and R phase. These intermetallics can adversely affect the mechanical properties, especially ductility and toughness. A brittle alloy can be hard but is not necessarily wear resistant due to chipping in the wearing process.

Molybdenum is employed in the alloy to enhance abrasion resistance by forming hard carbides. Also, Mo is employed to improve the alloy's corrosion resistance, especially in pitting environments, e.g., seawater. Though prior art alloys rely heavily on W to improve wear resistance, Mo atoms are much smaller than W atoms, and with an atomic weight roughly half the atomic weight of W, there are roughly twice as many Mo atoms for a given weight percentage. Molybdenum has a greater affinity for C than does W, and diffuses much more quickly due to its smaller size, thereby favoring the formation of carbides to impart abrasion resistance. Furthermore, Mo imparts greater corrosion resistance than does W in acidic environments of a reducing nature. While the corrosion resistance imparted by Mo is believed to be imparted by Mo in solid solution, the wear resistance is imparted primarily by the formation of Mo carbides. However, high Mo concentrations will lower the alloy's ductility, thereby reducing the alloy's utility as a weld overlay on substrates that have not been preheated. Also, high Mo concentrations lower the fluidity of the molten alloy. In one embodiment, the concentration of Mo in the alloy is between about 10 wt % and about 15 wt %. For example, the concentration of Mo is between about 11 wt % and about 14 wt %. In one such embodiment, the concentration of Mo is between about 11 wt % and about 13 wt %. In one preferred embodiment, the concentration of Mo is about 12.5 wt %.

Chromium is provided in the alloy of the invention to enhance the corrosion resistance and to form hard carbides to improve wear resistance. High Cr concentrations can cause the molten alloy to be sluggish or have poor flow properties, while also causing the final alloy to be brittle. In one embodiment, the concentration of Cr in the alloy is between about 20 wt % and about 30 wt %. For example, the concentration of Cr is between about 22 wt % and about 27 wt %. In one such embodiment, the concentration of Cr is between about 23 wt % and about 25 wt %. In one preferred embodiment, the concentration of Cr is about 24 wt %.

Nickel is included in the alloy to stabilize the ductile face-centered cubic phase of the Co-based alloy during cooling. In doing so, the alloy transforms to the harder hexagonal close-packed phase under stress during wear. The amount of Ni is limited because high Ni concentration can reduce the alloy's wear resistance. In one embodiment, the concentration of Ni in the alloy is between about 1 wt % and about 4 wt %. For example, the concentration of Ni is between about 2 wt % and about 4 wt %. In one such embodiment, the concentration of Ni is between about 3 wt % and about 4 wt %. In one preferred embodiment, the concentration of Ni is about 3.5 wt %.

Iron is a tolerated tramp element at a closely controlled concentration. An excessive amount of Fe has a detrimental effect on both the alloy's corrosion and wear resistance. Therefore, the concentration of Fe is no more than about 1 wt %.

Silicon may be incorporated in the alloy to facilitate melting and act as a deoxidizer. The concentration of Si should be high enough such that these advantageous affects can be realized in the alloy, but low enough such that brittle silicides do not form. For instance, if the Si concentration is too high, Si may combine with Mo to form brittle molybdenum silicides. In one embodiment, the Si concentration in the alloy is no more than about 1 wt %. In one preferred embodiment, the Si concentration is no more than about 0.7 wt %.

The alloys of the invention include one or more elements of Groups 4b and 5b in the periodic table, which are exceptional carbide formers. They are Ti, Zr, and Hf in Group 4b and V, Nb, and Ta in Group 5b. Thermodynamically, it is more favorable for carbides to form with the elements in these two groups than elements of Group 6b, which include Cr and Mo. Furthermore, carbides formed from these Group 4b and 5b elements generally have much higher melting points than those formed by Cr and Mo. For example, NbC has a melting point of 3500° C., much higher than that of typical cobalt alloys. Both Cr and Mo partition in complex carbides, such as $M_{23}C_6$, $M_7C_3$, and $M_6C$, which only precipitate out after the alloy solidifies at 1300° to 1400° C. During solidification of cobalt alloys, carbides involving Groups 4b and 5b elements are therefore expected to form before those involving the elements in Group 6b.

The elements in Groups 4b and 5b are also known to form intermetallic compounds in cobalt-based alloys. This presents a risk of causing brittleness if 4b/5b elements are not tied up with carbon. The alloys of this invention are designed to leave very little of these elements free in solid solution. This is accomplished in this invention by considering their stoichiometric weight ratios to carbon as shown below:

Nb/C=7.74:1
Ta/C=15.08:1
Hf/C=14.86:1
Zr/C=7.6:1
V/C=4.24:1
Ti/C=3.99:1

If a stoichiometric ratio is exceeded, there is untied element that could potentially form intermetallic phases. Conversely with too small a ratio, there is too much carbon left free to consume needed Cr and Mo. The alloys of this invention therefore have the optimal ratios of 30 to 90% of the stoichiometric ratios in order to achieve the desired properties. If the ratio is higher than 90% of the stoichiometric ratio, there could be free atoms of elements in Groups 4b and 5b, which may result in formation of brittle intermetallic phases. If the stoichiometric ratio is lower than 30%, there could be carbon left available to combine with Cr and Mo, thereby, reducing the corrosion resistance. The formation of Cr and Mo carbides depends also on the cooling rate. If the cooling rate is high, the ratio can be as low as 30% because of insufficient time for Cr and Mo carbides to form. The alloys of this invention have one of the following carbide-former elements in the following approximate weight ratios, which are between 30 and 90% of the stoichiometric weight ratios:

| | |
|---|---|
| Nb/C | 2.3:1 to 7:1 |
| Ta/C | 4.5:1 to 13.6:1 |
| Hf/C | 4.5:1 to 13.4:1 |
| Zr/C | 2.3:1 to 6.8:1 |
| V/C | 1.3:1 to 3.8:1 |
| Ti/C | 1.2:1 to 3.6:1 |

That is, the alloy contains Nb such that Nb:C weight ratio is from about 2.3:1 to about 7:1; or Ta such that Ta:C weight ratio is from about 4.5:1 to about 13.6:1; or Hf such that Hf:C weight ratio is from about 4.5:1 to about 13.4:1; or Zr such that Zr:C weight ratio is from about 2.3:1 to about 6.8:1; or V such that V:C weight ratio is from about 1.3:1 to about 3.8:1; or Ti such that Ti:C weight ratio is from about 1.2:1 to about 3.6:1.

In particular, this is a ratio of, for example, the weight% Nb to the weight% C in the alloy. So this means that where Nb is employed, C is between 0.12 and 0.7, so Nb is between 0.28 wt % to 4.9 wt % of the alloy.

Other elements such as B and Cu can be present as incidental impurities or as intentional additions. Boron can be incorporated in the alloy to lower the alloy's melting temperature, thereby facilitating complete melting of the alloy and increasing the fluidity or flow characteristics of the molten alloy. Boron also promotes fusion of the alloy powder in spray-and-fuse methods and powder metallurgy processing. Copper can be included in the alloy to promote resistance to corrosion from micro-organisms in the alloy's environment, such as when the alloy is exposed to seawater. In particular, up to about 3 wt %, preferably up to about 1.5 wt %, of these elements cumulatively are included in the alloy.

To minimize the possibility of forming intermetallics, calculation of electron vacancy numbers is performed using an aerospace standard entitled "Calculation of Electron Vacancy Number in Superalloys" (SAE AS5491). The electron vacancy number (Nv) thus calculated represents the possibility of forming the intermetallic precipitates. A low Nv number means less possibility and therefore, is desirable for achieving proper mechanical properties. This invention uses a modified version of the calculating method.

The alloy's composition is preferably controlled such that the electron vacancy number, $N_v$, as calculated by SAE Specification AS5491 (Revision B) is carefully controlled to a value less than about 2.80, preferably less than about 2.75. It is also controlled to a value greater than about 2.3, preferably between about 2.32 and about 2.75. This specification AS5491 is incorporated by reference in its entirety, and is available for ordering from www.sae.org. An alloy's $N_v$ is defined as the average number of electron vacancies per 100 atoms of the alloy, and is closely related to the type of phases that will develop in the alloy and the sequence in which they form. It is calculable by the following equation:

$$N_v = \Sigma\, m_i (N_v)_i$$

Where $N_v$ is the electron vacancy number for the alloy, $m_i$ is the atomic mass fraction of the "i"th element in the alloy, and $(N_v)_i$ is the electron vacancy number for the "i"th element.

In the context of the present invention, it is taken into consideration that because this SAE standard SAE AS5491 was designed with low-carbon structural alloys in mind, it does not consider the formation of carbides by the elements in Groups 4b and 5b. The present invention is based on the assumption that these elements are completely tied up with carbon because the ratio to carbon falls within the conservatively substoichiometric ranges listed above. Therefore, Nv numbers are calculated for the alloys of the invention using a modified version, which assumes no elements in Group 4b and 5b are available to form intermetallic phases. So notwithstanding the presence of one or more of these elements, the input wt % for each of these elements in the calculation is zero.

By controlling the alloy's $N_v$ in accordance with this particular preferred embodiment of the invention, applicants have discovered that the formation of brittle phases is restrained and, therefore, the alloy's propensity for brittle fracture or failure is reduced. For example, in one application, the alloy's $N_v$ is below about 2.75. In general, an approach to controlling the $N_v$ in accord with this invention is to reduce the concentration of Si while increasing the concentration of Ni and C. Also, while less Cr and Mo would decrease the alloy's $N_v$ further, the minimum concentrations recited herein are necessary for the alloy's desirable properties. Accordingly, the alloy's $N_v$ will generally be greater than about 2.25, such as greater than about 2.32. Therefore, in one embodiment, the alloy's $N_v$ is between about 2.3 and about 2.8, such as between about 2.32 and about 2.75 or between about 2.40 and about 2.60.

This alloy composition, in a preferred form, comprises the following, by approximate weight % (all percentages herein are by weight):

| | |
|---|---|
| C | 0.12-0.7 |
| Cr | 20-30 |
| Mo | 7-15 |
| Ni | 1-4 |
| Co | balance |

For example, the alloy comprises the following, by approximate weight %:

| | |
|---|---|
| C | 0.2-0.4 |
| Cr | 22-27 |

-continued

| | |
|---|---|
| Mo | 11-14 |
| Ni | 3-4 |
| Co | balance. |

The alloy further comprises one of the following carbide formers in a weight percent to fall within this ratio of weight percents:

| | |
|---|---|
| Nb/C | 2.3:1 to 7:1 |
| Ta/C | 4.5:1 to 13.6:1 |
| Hf/C | 4.5:1 to 13.4:1 |
| Zr/C | 2.3:1 to 6.8:1 |
| V/C | 1.3:1 to 3.8:1 |
| Ti/C | 1.2:1 to 3.6:1. |

Niobium in a weight ratio to C of 2.3:1 stoichiometrically offsets about 30% of the C, and Nb in a weight ratio to C of 7:1 stoichiometrically offsets about 90% of the C. Corresponding relationships apply to these other carbide formers.

Alternatively, two or more of these carbide formers can be employed, with their respective weight percents offsetting each other such that the cumulative carbide former does not exceed 90% of the stoichiometric value for the given C content. For example, Nb is employed in a concentration which stoichiometrically offsets about 50% or less of the C content in combination with V in a concentration which offsets about 40% or less of the C content.

The alloy may further comprise

| | |
|---|---|
| Si | up to about 1 |
| Mn | up to about 1 |
| Fe | up to about 1 |
| W | up to about 1 and/or |
| B + Cu | up to about 3. |

The microstructure of an investment casting of the alloy of this invention is shown in FIG. 1. The NbC particles are too small to be observed. It is interesting to note that even with slow cooling in investment casting, no large carbides were observed. The alloy's microstructure is hypoeutectic, having Co—Cr phase particles as the major constituent. These particles are the first to solidify next to the very small NbC particles as the alloy cools, doing so as dendrites to form a Cr-rich region. Further, secondary carbides also begin to form as the alloy cools. These carbides are mostly the Cr-rich $M_{23}C_6$ and Mo-rich $M_6C$ eutectic carbides. As the alloy continues to cool, a eutectic structure forms in between the dendrites and carbides in a lamellar fashion, and which is a Mo-rich region.

The carbides are very finely dispersed in the alloy's eutectic regions. Little or no primary carbides (e.g., $M_7C_3$), which normally appear when the concentration of C is high (i.e., between about 0.8-3.5 wt %), are present in the alloy because of the carefully controlled C concentration. These primary carbides have higher C concentrations, are bulky and angular in shape, and typically increase an alloy's brittleness while reducing the alloy's corrosion resistance. In one embodiment, at least about 80% of the carbides in the alloy are secondary carbides. For example, at least about 90% of the carbides in the alloy are secondary carbides. In one preferred embodiment, substantially all of the carbides formed in the alloy are secondary carbides.

In accordance with the invention, the alloy is prepared in a form suitable for surface-treatment applications. For example, the alloy can be prepared in powder form, as rods, as castings, as consumable electrodes, or as solid or tubular wires.

In one embodiment, in order to overlay the alloy composition as an overlay on a substrate, the inventors have developed a mechanism of a Co-based sheath with alloying constituents in the form of metal powder or particulates therein. In one such embodiment, the Co-based sheath is at least about 95 wt % Co, with the remainder comprising Fe and Ni. Other alloying elements, such as C, Cr, Mo, Ni, and perhaps additional Co, are in powder form held within the sheath. The powder alloying elements are present in a proportion such that, when coalesced with the Co-based sheath during the overlay operation, an overall alloy composition as described above is attained. In one embodiment, a wire fabricating machine is used to form the sheath and powder into a tubular wire. Here, the alloy powder mixture is fed onto the flat Co-based sheath as a narrow strip. The sheath is then formed into a tubular wire with the powder therein. The tubular wire is further formed by at least one additional rolling or drawing operation. These subsequent forming operations reduce the outer diameter of the tubular wire and compact the powder therein.

The Co-based sheath is engineered to have a wall thickness and diameter such that it is readily formable and provides an interior volume of the correct size to hold a volume of powder which, when all are coalesced, yields the desired final alloy composition. The specific powder composition is calculated for a particular sheath as a function of the sheath's wall thickness. For sheaths with thicker walls, an additional amount of non-Co alloying elements are included in the powder to avoid a coalesced alloy composition that has excess Co content. For sheaths with thinner walls, either (1) a lower amount of non-Co alloying elements or (2) additional Co in the form of powder or particles is included in the powder to avoid a coalesced alloy composition that is Co-deficient. In one embodiment, the outer diameter of the wire is between about 0.9 mm and about 4 mm. In another embodiment, possibly in conjunction with the previous embodiment, the sheath's wall has a thickness between about 0.15 mm and about 0.5 mm.

In one aspect of this invention, the alloy may be used in an overlay process. Here, any welding or similar technique suitable for use in an overlay application can be used. For example, plasma transferred arc welding (PTA), gas tungsten arc welding, gas metal arc welding, laser cladding, and spray-and-fuse methods can be used to apply the alloy as an overlay. Laser cladding is similar to PTA in principle, except that it employs a laser beam rather than transferred arc as the energy source. The laser beam can be generated with carbon dioxide, yttria-alumina-garnet (YAG), or diodes. In any of the above techniques, localized heat is generated near the surface of the substrate to be treated, having been optionally preheated. The Co-based alloy is then brought near the heat source to sufficiently melt the alloy, forming a weld pool on the substrate comprising the molten Co-based alloy and some molten substrate material. As the weld pool solidifies, a Co-based alloy overlay is formed, which is substantially free of thermal stress-induced fractures.

Another general method of applying a coating is by a spray-and-fuse coating method, which involves first melting the Co-based alloy, spraying the molten alloy onto a substrate, then fusing the sprayed alloy coating with a heat source. Typical heat sources include, e.g., induction heating, a laser, an infrared heat source, and a non-transferred plasma arc. Alternatively, the whole work piece could be placed in a furnace to achieve fusion of the coating.

In one preferred embodiment, PTA welding is employed to form the overlay. Here, heat is generated by an arc formed between the substrate and a nonconsumable tungsten electrode. This heat produces coalescence of the Co-based alloy and between the Co-based alloy and the substrate. A nozzle is in place around the arc, increasing the arc temperature and further concentrating the heat pattern compared to other techniques. A gas is used for shielding the molten weld metal. Using tungsten electrodes is preferred because of tungsten's high melting temperature and because it is a strong emitter of electrons.

Advantageously, preheating is optional; that is, the substrate does not have to be preheated in accord with the invention to achieve a coating or overlay that is substantially free of thermal stress-induced fractures, regardless of the specific technique employed.

EXAMPLE 1

Cobalt-based Alloy 3 (Sample 3) of the present invention was made in the form of powder for making samples using plasma transferred arc welding equipment. It is compared with alloys 1 and 2 (Samples 1 and 2), and with Ultimet, which is a commercial product of U.S. Pat. No. 5,002,731. The chemical compositions are listed below:

| Alloy | Cr | Mo | W | Nb | Si | Fe | Ni | C |
|---|---|---|---|---|---|---|---|---|
| 1 | 28.5 | 12.4 | — | — | 1.13 | 0.25 | 1.5 | 0.26 |
| 2 | 24.2 | 12.2 | — | — | 0.15 | 0.73 | 3.2 | 0.54 |
| 3 | 24.0 | 12.5 | — | 2 | 0.54 | 0.67 | 3.5 | 0.36 |
| Ultimet | 26 | 6 | 2 | — | 1 | 3 | 10 | 0.06 |

EXAMPLE 2

Figure 2:
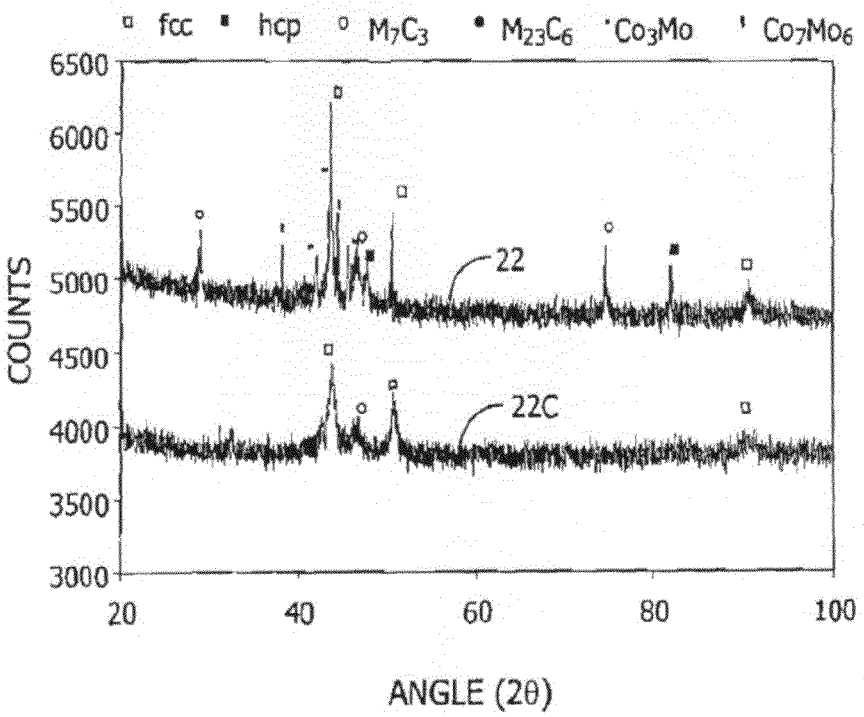
FIG. 2 is an X-ray diffraction analysis.

Analysis of the 1 and 2 samples using X-ray diffraction showed that Sample 2 consists essentially of two phases: a face-centered cubic (fcc) phase and a primary carbide phase of $M_7C_3$. In contrast, Sample 1 comprises a plurality of phases including, e.g., the fcc and the primary carbide phases, as well as a hexagonal-close-packed phase, a secondary carbide phase ($M_{23}C_6$), an first intermetallic phase ($Co_3Mo$), and a second intermetallic phase ($Co_7Mo_6$). Without being bound to a particular theory, it is believed that Sample 2's improved ductility is due in large part to the reduced number of phases in the Sample 2's microstructure. The X-ray diffraction analysis results are shown in FIG. 2, with alloy 1 designated 22 and 2 designated 22C.

EXAMPLE 3

The electron vacancy numbers of Samples 1 and 2 were calculated in accordance with SAE AS5491:

| Sample 1 | | | | | | | | |
|---|---|---|---|---|---|---|---|---|
| Element | Wt % | Atomic Wt | Wt %/ At. Wt | Atomic Fraction | Precip Adj | Matrix Atomic Fraction | Nv | Nv Product |
| Cr | 28.5 | 52 | 0.5481 | 0.3218 | 0.2899 | 0.3073 | 4.66 | 1.432 |
| Ti | | 47.9 | 0.0000 | 0.0000 | 0.0000 | 0.0000 | 6.66 | 0.000 |
| Mo | 12.4 | 95.94 | 0.1292 | 0.0759 | 0.0738 | 0.0782 | 4.66 | 0.364 |
| Al | | 26.98 | 0.0000 | 0.0000 | 0.0000 | 0.0000 | 7.66 | 0.000 |

-continued

Sample 1

| Element | Wt % | Atomic Wt | Wt %/ At. Wt | Atomic Fraction | Precip Adj | Matrix Atomic Fraction | Nv | Nv Product |
|---|---|---|---|---|---|---|---|---|
| Co | 55.96 | 58.93 | 0.9496 | 0.5575 | 0.5575 | 0.5910 | 1.71 | 1.011 |
| B | | 10.81 | 0.0000 | 0.0000 | 0.0000 | 0.0000 | 7.66 | 0.000 |
| Zr | | 91.22 | 0.0000 | 0.0000 | 0.0000 | 0.0000 | 6.66 | 0.000 |
| C | 0.26 | 12.01 | 0.0216 | 0.0127 | 0.0000 | 0.0000 | 0 | 0.000 |
| Si | 0.25 | 28.09 | 0.0089 | 0.0052 | 0.0052 | 0.0055 | 6.66 | 0.037 |
| Mn | | 54.94 | 0.0000 | 0.0000 | 0.0000 | 0.0000 | 3.66 | 0.000 |
| Fe | 1.13 | 55.85 | 0.0202 | 0.0119 | 0.0119 | 0.0126 | 2.66 | 0.033 |
| Cu | | 63.54 | 0.0000 | 0.0000 | 0.0000 | 0.0000 | 0 | 0.000 |
| V | | 50.94 | 0.0000 | 0.0000 | 0.0000 | 0.0000 | 5.66 | 0.000 |
| W | | 183.85 | 0.0000 | 0.0000 | 0.0000 | 0.0000 | 4.66 | 0.000 |
| Ta | | 180.95 | 0.0000 | 0.0000 | 0.0000 | 0.0000 | 5.66 | 0.000 |
| Cb | | 92.91 | 0.0000 | 0.0000 | 0.0000 | 0.0000 | 5.66 | 0.000 |
| Hf | | 178.49 | 0.0000 | 0.0000 | 0.0000 | 0.0000 | 6.66 | 0.000 |
| Re | | 186.21 | 0.0000 | 0.0000 | 0.0000 | 0.0000 | 4.66 | 0.000 |
| Ni | 1.5 | 58.71 | 0.0255 | 0.0150 | 0.0051 | 0.0054 | 0.61 | 0.003 |
| Sum | 100 | | 1.7033 | 1.0000 | 0.9434 | | | 2.88 |

Sample 2

| Element | Wt % | Atomic Wt | Wt %/ At. Wt | Atomic Fraction | Precip Adj | Matrix Atomic Fraction | Nv | Nv Product |
|---|---|---|---|---|---|---|---|---|
| Cr | 24.2 | 52 | 0.4654 | 0.2720 | 0.2178 | 0.2342 | 4.66 | 1.091 |
| Ti | | 47.9 | 0.0000 | 0.0000 | 0.0000 | 0.0000 | 6.66 | 0.000 |
| Mo | 12.2 | 95.94 | 0.1272 | 0.0743 | 0.0699 | 0.0752 | 4.66 | 0.350 |
| Al | | 26.98 | 0.0000 | 0.0000 | 0.0000 | 0.0000 | 7.66 | 0.000 |
| Co | 58.98 | 58.93 | 1.0008 | 0.5849 | 0.5849 | 0.6288 | 1.71 | 1.075 |
| B | | 10.81 | 0.0000 | 0.0000 | 0.0000 | 0.0000 | 7.66 | 0.000 |
| Zr | | 91.22 | 0.0000 | 0.0000 | 0.0000 | 0.0000 | 6.66 | 0.000 |
| C | 0.54 | 12.01 | 0.0450 | 0.0263 | 0.0000 | 0.0000 | 0 | 0.000 |
| Si | 0.15 | 28.09 | 0.0053 | 0.0031 | 0.0031 | 0.0034 | 6.66 | 0.022 |
| Mn | | 54.94 | 0.0000 | 0.0000 | 0.0000 | 0.0000 | 3.66 | 0.000 |
| Fe | 0.73 | 55.85 | 0.0131 | 0.0076 | 0.0076 | 0.0082 | 2.66 | 0.022 |
| Cu | | 63.54 | 0.0000 | 0.0000 | 0.0000 | 0.0000 | 0 | 0.000 |
| V | | 50.94 | 0.0000 | 0.0000 | 0.0000 | 0.0000 | 5.66 | 0.000 |
| W | | 183.85 | 0.0000 | 0.0000 | 0.0000 | 0.0000 | 4.66 | 0.000 |
| Ta | | 180.95 | 0.0000 | 0.0000 | 0.0000 | 0.0000 | 5.66 | 0.000 |
| Cb | | 92.91 | 0.0000 | 0.0000 | 0.0000 | 0.0000 | 5.66 | 0.000 |
| Hf | | 178.49 | 0.0000 | 0.0000 | 0.0000 | 0.0000 | 6.66 | 0.000 |
| Re | | 186.21 | 0.0000 | 0.0000 | 0.0000 | 0.0000 | 4.66 | 0.000 |
| Ni | 3.2 | 58.71 | 0.0545 | 0.0319 | 0.0468 | 0.0503 | 0.61 | 0.031 |
| Sum | 100 | | 1.7113 | 1.0000 | 0.9301 | | | 2.59 |

Sample 1 had an electron vacancy number of 2.88, which is outside the preferred range, whereas Sample 2 had an electron vacancy number of 2.59, which is in the preferred range. Sample 3 was also calculated, by the modified method of ignoring the Nb content, to be 2.72.

EXAMPLE 4

To compare the ductility of the samples, an impact test conducted at room temperature was performed according to ASTM E23-06. The samples were 0.5"×0.5"×2.5" in a simple beam (Charpy) configuration. The results showed a marked increase in impact energy dissipated by the samples, with Sample 1 recording 9 ft-lb and Sample 2 recording 22 ft-lb.

| Alloy | Nv | Impact Energy, fl-lb |
|---|---|---|
| 22 | 2.88 | 9 |
| 22C | 2.59 | 22 |

EXAMPLE 5

The alloys were tested according to ASTM G-48, Method C. Although Alloy 2 showed high toughness, the corrosion tests according to ASTM G-48, Method C found its pitting temperature at less than 45° C. The pitting temperature of Alloy 1 was also less than 45° C. With the Nb-containing 3, the critical pitting temperature (CPT) was found to be over 70° C., between 70° C. and 75° C. The main difference in chemical composition between Alloy 3 and Alloys 1 and 2 is the presence of Nb in Alloy 3 indicating that there are more Cr and Mo atoms remaining in solid solution to resist corrosion in Alloy 3 due to the fact that much of the carbon is tied up by Nb. This is reflected in the substantially higher corrosion pitting temperature of Alloy 3 versus that of Alloys 1 and 2.

EXAMPLE 6

For abrasion resistance, the ASTM G65 dry sand abrasion test was used to compare the performance of alloy Samples 2, 3, and Ultimet. The results are given below:

| Alloy | Volume Loss ($mm^3$) | Hardness (Rockwell C) |
|---|---|---|
| 2 | 63 | 38 |
| 3 | 63 | 38 |
| Ultimet | 91 | 23 |

Compared to Ultimet, the lower volume loss in both Samples 2 and 3 indicates better abrasion resistance. These results are consistent with the hardness measurements as listed, indicating no brittle fracture occurred in either 2 or 3 during the abrasion tests.

EXAMPLE 7

Metallography was performed on Sample 3 and revealed a microstructure containing a slow cooled investment cast microstructure which has no large primary carbides present and very little secondary Mo carbides, as shown in FIG. 1.

EXAMPLE 8

Alloys 1, 2, and 3 were deposited on substrates by plasma transferred arc (PTA) overlay. Alloy 1 had good weldability but was shown to be brittle when deposited at high speeds. Alloy 2 was shown to have poor weldability. Alloy 3 was shown to have excellent weldability even at high speed, demonstrating that cracks in an overlay of Alloy 3 can be repaired well. The hardnesses of the three samples upon PTA deposition were HRC (Rockwell C) 44, 38, and 38 for Alloys 1, 2, and 3, respectively.

EXAMPLE 9

Alloy 3 was compared to Stellite 21, an alloy containing, nominally by weight %, 28-Cr, 0.25-C, 3-Ni, 5.2-Mo, Fe-<3, Si-<1.5, Co-balance. The hardnesses for Alloy 3 were HRC 38 at room temperature for a PTA deposit and an estimated HRC 40 as cast. The hardnesses for Stellite 21 were HRC 33 at room temperature for a PTA deposit and HRC 35 as cast. For abrasion resistance tested under the ASTM G65 dry sand abrasion test, Alloy 3 suffered 60 $mm^3$ volume loss versus 76 $mm^3$ for Stellite 21. Under corrosion tests according to ASTM G-48, Method C, Alloy 3 had a critical pitting temperature of 70° C. to 75° C., versus less than 45° C. for Stellite 21.

EXAMPLE 10

Powder of Alloy 3 was deposited by laser cladding on the edges of a trim die, and the service life of the deposit was determined to be at least three times the service life of tool steel H13.

When introducing elements of the present invention or the preferred embodiment(s) thereof, the articles "a," "an," "the," and "said" are intended to mean that there are one or more of the elements. The terms "comprising," "including "having" are intended to be inclusive and mean that there may be additional elements other than the listed elements.

In view of the above, it will be seen that the several objects of the invention are achieved and other advantageous results attained.

As various changes could be made in the above methods and products without departing from the scope of the invention, it is intended that all matter contained in the above description and shown in the accompanying drawings shall be interpreted as illustrative and not in a limiting sense.

The invention claimed is:

1. A wear-and corrosion-resistant alloy for forming a weld overlay over a metallic component, the alloy consisting of, by approximate weight %:

| | |
|---|---|
| C | 0.2-0.4 |
| Cr | 22-27 |
| Mo | 11-14 |
| Ni | 3-4 |
| Co | Balance |
| Si | up to about 1 |
| Mn | up to about 1 |
| Fe | up to about 1 |
| W | up to about 1 |
| B + Cu | up to about 3 |

wherein the alloy further contains Nb as a carbide-former in a concentration to provide a weight ratio of Nb to C between 2.3:1 and 7:1 to stoichiometrically offset between about 30% and about 90% of the C in the alloy, such that Nb is consumed in the formation of carbides and is not available for formation of brittle intermetallic phases and such that carbon is thereby consumed by Nb in the formation of Nb carbides, which carbon is therefore unavailable to consume Mo and Cr by formation of Mo and Cr carbides; and wherein the alloy has an electron vacancy number between 2.3 and 2.80 as calculated using SAE specification AS5491 (Revision B), with no contribution from the carbide-former element.

2. A method for forming a wear-and corrosion-resistant overlay on a metal substrate comprising:

applying to the metal substrate the alloy of claim 1; and solidifying the molten material on the substrate to form said overlay comprising said Co—Cr—Mo alloy.

3. The method of claim 2 wherein the overlay has a surface area which is greater than 1 $m^2$ and has a thickness between about 50 microns and 10 mm.

4. The method of claim 2 wherein the substrate is is Fe-based.

5. The wear-and corrosion-resistant alloy of claim 1 wherein said electron vacancy number is between 2.32 and 2.75.

6. The wear- and corrosion-resistant alloy of claim 1 wherein said electron vacancy number is between 2.4 and 2.6.

* * * * *